US007581408B2

(12) United States Patent
Stark

(10) Patent No.: US 7,581,408 B2
(45) Date of Patent: Sep. 1, 2009

(54) HYBRID DEHUMIDIFICATION SYSTEM FOR APPLICATIONS WITH HIGH INTERNALLY-GENERATED MOISTURE LOADS

(76) Inventor: Walter Stark, 3 Connelly Rd., Huntington, NY (US) 11743

( * ) Notice: Subject to any disclaimer, the term of this patent is extended or adjusted under 35 U.S.C. 154(b) by 6 days.

(21) Appl. No.: 12/005,453

(22) Filed: Dec. 27, 2007

(65) Prior Publication Data

US 2009/0165485 A1 Jul. 2, 2009

(51) Int. Cl.
*F25D 17/06* (2006.01)

(52) U.S. Cl. ..... 62/93

(58) Field of Classification Search ..... 62/92, 62/93, 271

See application file for complete search history.

(56) References Cited

U.S. PATENT DOCUMENTS 1,986,863 A * 1/1935 Matson ..... 62/173
2,093,968 A * 9/1937 Kettering ..... 62/176.6
4,512,397 A 4/1985 Stark
4,761,966 A 8/1988 Stark
5,816,315 A 10/1998 Stark
5,893,408 A 4/1999 Stark
5,913,360 A 6/1999 Stark
6,182,747 B1 2/2001 Stark

OTHER PUBLICATIONS

"GEA-Fricostar: The Systematic Approach" by GEA. Apr. 2001.
"Comfortable Swimming in Every Climate" by Dantherm Air Handling. www.danterm-air-handling.com May 2008.

* cited by examiner

*Primary Examiner*—Melvin Jones
(74) *Attorney, Agent, or Firm*—Alfred M. Walker

(57) ABSTRACT

A hybrid dehumidification system uses both mechanical cooling and ventilation to control humidity under control of a system which selects the best mode of operation under a given set of conditions. A purge mode using 100% outside air and exhaust is also supported to decontaminate a space. Either a single large plate heat exchanger or multiple small plate heat exchangers may be employed in the system.

17 Claims, 10 Drawing Sheets

HYBRID DEHUMIDIFICATION SYSTEMS FOR USE WITH SINGLE LARGE PLATE HEAT EXCHANGER IN MECHANICAL DEHUMIDIFICATION MODE (OCCUPIED)

HYBRID DEHUMIDIFICATION SYSTEMS FOR USE WITH SINGLE LARGE PLATE HEAT EXCHANGER IN MECHANICAL DEHUMIDIFICATION MODE (OCCUPIED)

HYBRID DEHUMIDIFICATION SYSTEMS FOR USE WITH SINGLE LARGE PLATE HEAT EXCHANGER IN MECHANICAL DEHUMIDIFICATION MODE (UNOCCUPIED)

NOTE: Unoccupied operation may also revert to winter mode where pure ventilation is the only means for dehumidification.

HYBRID DEHUMIDIFICATION SYSTEMS FOR USE WITH SINGLE LARGE PLATE HEAT EXCHANGER IN OUTSIDE AIR DEHUMIDIFICATION MODE (OCCUPIED & UNOCCUPIED)

HYBRID DEHUMIDIFICATION SYSTEMS FOR USE WITH SINGLE LARGE PLATE HEAT EXCHANGER IN PURGE MODE

HYBRID DEHUMIDIFICATION SYSTEMS FOR USE WITH MULTIPLE SMALL PLATE HEAT EXCHANGERS

HYBRID DEHUMIDIFICATION SYSTEMS FOR USE WITH MULTIPLE SMALL PLATE HEAT EXCHANGERS IN MECHANICAL DEHUMIDIFICATION MODE (OCCUPIED)

HYBRID DEHUMIDIFICATION SYSTEMS FOR USE WITH MULTIPLE SMALL PLATE HEAT EXCHANGERS IN MECHANICAL DEHUMIDIFICATION MODE (UNOCCUPIED)

NOTE: Unoccupied operation may also revert to winter mode where pure ventilation is the only means for dehumidification.

HYBRID DEHUMIDIFICATION SYSTEMS FOR USE WITH MULTIPLE SMALL PLATE HEAT EXCHANGERS IN OUTSIDE AIR DEHUMIDIFICATION MODE (OCCUPIED & UNOCCUPIED)

HYBRID DEHUMIDIFICATION SYSTEMS FOR USE WITH MULTIPLE SMALL PLATE HEAT EXCHANGERS IN PURGE MODE

HYBRID DEHUMIDIFICATION SYSTEMS CONTROL SEQUENCE

NOTE:
1. Unoccupied periods may optionally revert to winter mode, year round.
2. RA Humidity set-point is reset downward, based upon cold surface temperature sensor reading

HYBRID DEHUMIDIFICATION SYSTEM FOR APPLICATIONS WITH HIGH INTERNALLY-GENERATED MOISTURE LOADS

FIELD OF THE INVENTION

The present invention relates to dehumidification in high moisture load environments.

BACKGROUND OF THE INVENTION

Dehumidification can be accomplished by mechanically lowering the dew-point of air, using a refrigeration based system, to a predetermined temperature and humidity level that removes a desired amount of moisture or by using outdoor air that is at the predetermined temperature and humidity level or lower.

In many geographic locations, dehumidification using only outdoor air is not practical because the outdoor dew point exceeds the indoor dew point too frequently. Under these conditions indoor humidity is not controlled, causing discomfort and the growth of mold and mildew. Consequently, most systems use refrigeration based dehumidification to maintain indoor humidity for some portion of the year.

OBJECTS OF THE INVENTION

It is therefore an object of the present invention to provide a dehumidification system which can be used in high moisture load environments.

It is also an object of the present invention to provide a hybrid dehumidification system which utilizes both mechanical and ventilation modes and which promotes modulated dehumidification of air in an enclosed space.

Other objects which become apparent from the following description of the present invention.

SUMMARY OF THE INVENTION

The invention uses both refrigeration and ventilation to control humidity; with a control system that determines which mode is best under a given set of conditions.

In the mechanical dehumidification mode, the required outside air and exhaust air for ventilation is furnished by a minimum outside air and minimum exhaust air damper that introduces the outside air necessary to ventilate the enclosed space and exhaust air sufficient to maintain negative pressure within the enclosed space as may be required by design or code and to avoid "pushing" humid air into adjacent spaces or into cold wall cavities where it can condense and cause damage. In the outdoor air dehumidification mode the ventilation is easily met except possibly at very low outdoor temperatures, in which case the outdoor air required to meet the ventilation requirement may cause the indoor humidity to fall below set point. An air bypass is also provided with regulating orifice in the event that additional airflow is needed to meet the total system airflow requirement. The invention has a purge feature that allows the system to operate with 100% outside air/100% exhaust to purge the enclosed space of contaminants such as excessive chloramines in an indoor swimming pool environment.

For indoor pools, a certain amount of outside air needed to meet minimum ventilation standards. This outside air is used to ventilate chemical odors and to supply fresh air for the occupants. During unoccupied periods outside air for ventilation is not necessary. Also, during unoccupied periods in summer, relative humidity can be allowed to rise to higher levels without danger of hidden damage due to condensation inside wall and ceiling cavities. Therefore, in the interest of saving energy, either of two strategies can be used for unoccupied periods.

1. Place the system in outside air ventilation mode regardless of the season. Using this strategy, the indoor humidity may be higher than design with the space unoccupied but this is of little concern when the outdoor temperatures are higher. Energy savings occurs as a result of shutting down mechanical dehumidification.
2. Shut down the minimum outside air damper when operating in the mechanical dehumidification mode. Using this strategy the indoor humidity is maintained year round. Energy savings occurs as a result of reduced outside air to be treated.

The invention may use single large plate heat exchangers and the invention can use multiple small plate heat exchangers as taught in U.S. Pat. No. 5,816,315, Plate type crossflow air-to-air heat exchanger having dual pass cooling and U.S. Pat. No. 6,182,747, Plate-type crossflow air-to-air heat-exchanger comprising side-by-side-multiple small-plates. A manifold T2/T3 must be added for the invention to work with multiple-small-plate technology.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1A:
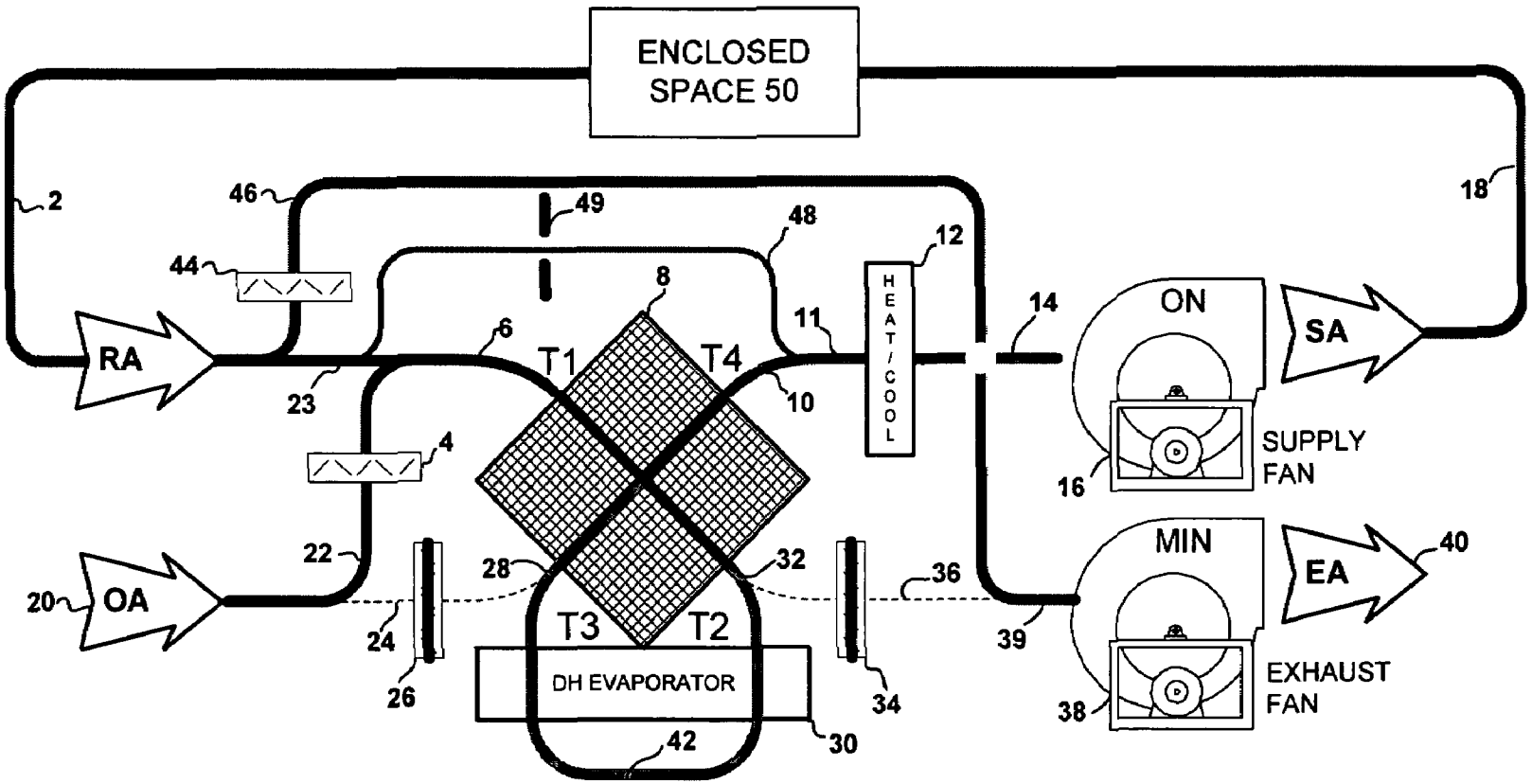
FIG. 1*a* illustrates a single large plate heat exchanger with airflow paths in the mechanical dehumidification/occupied mode with the minimum outside air and minimum exhaust air dampers open, the outside air and exhaust air dampers closed and the exhaust fan removing sufficient quantity of exhaust to maintain negative pressure in the enclosed space.

The invention uses at least one modulating outside air damper 26 and at least one modulating exhaust air damper 34 and a variable volume exhaust fan 38 to achieve fully modulated dehumidification in the outside air operating mode and to switch the airflow between outside air dehumidification and mechanical dehumidification modes. An air bypass 48 is also provided with regulating orifice 49 in the event that additional airflow is needed to meet the total system airflow requirement. Modulating exhaust air damper 34 may be of the passive or non-powered type where only pressure differential in the correct direction will open the damper. Both supply fan 16 and exhaust fan 38 are in a "draw-through" position relative to the plate heat exchanger 8, thereby minimizing the stress on the plates caused by pressure differential. Plate heat exchangers are positioned in a counterflow arrangement and condensate, in both operating modes, flows downward in the same direction as airflow, thereby ensuring complete drainage and minimizing pressure drop from suspended water.

FIG. 1*a* illustrates the invention with a single large plate heat exchanger 8, operating in the mechanical dehumidification/occupied mode. Return airstream 2 enters the process where it gives up a portion of its volume to minimum exhaust airstream 46 through minimum exhaust air damper 44 where it continues on to exhaust fan 38 where it discharge outdoors through airstream 40. Meanwhile, airstream 23 continues on to mix with minimum outside airstream 22 through minimum outside air damper 4. Airstream 6 enters the first pass of heat exchanger 8, where it is cooled and dehumidified emerging as airstream 42 which travels through dehumidifying coil 30 for final cooling and dehumidification prior to entering the second pass of heat exchanger 8 where it is heated and emerges as airstream 10. Airstream 10 receives further heating or cooling in heating and/or cooling coil 12, emerging as airstream 14 prior to entering supply fan 16 where it is supplied back to the enclosed space 50 through supply airstream 18.

Figure 1B:
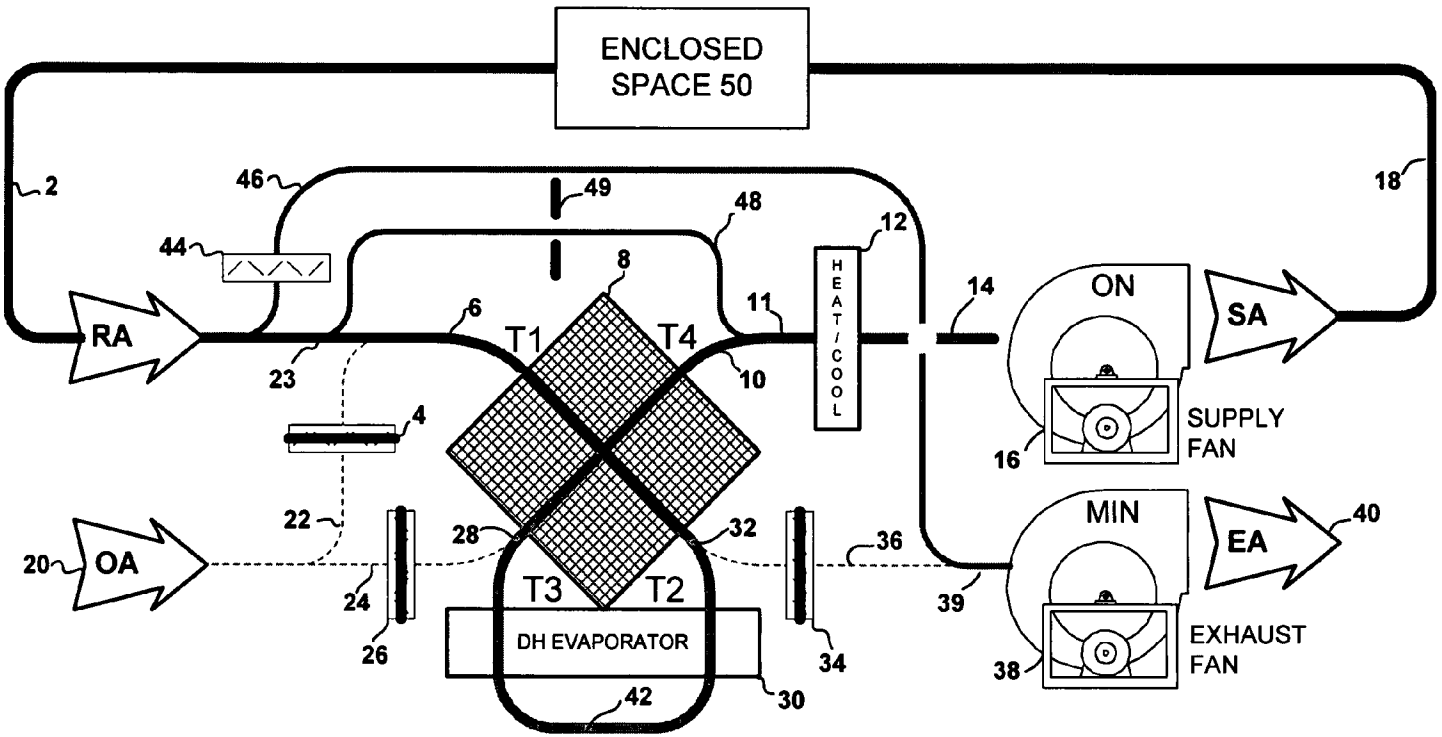
FIG. 1*b* illustrates a single large plate heat exchanger with airflow paths in the mechanical dehumidification mode during unoccupied periods with the minimum outside air damper closed and minimum exhaust air damper open, and the exhaust fan removing sufficient quantity of exhaust to maintain negative pressure in the enclosed space.

FIG. 1*b* illustrates the invention with a single large plate heat exchanger 8, operating in the mechanical dehumidification mode during unoccupied periods. Operation is the same as 1*a* above except that minimum outside air damper closes.

Figure 2:
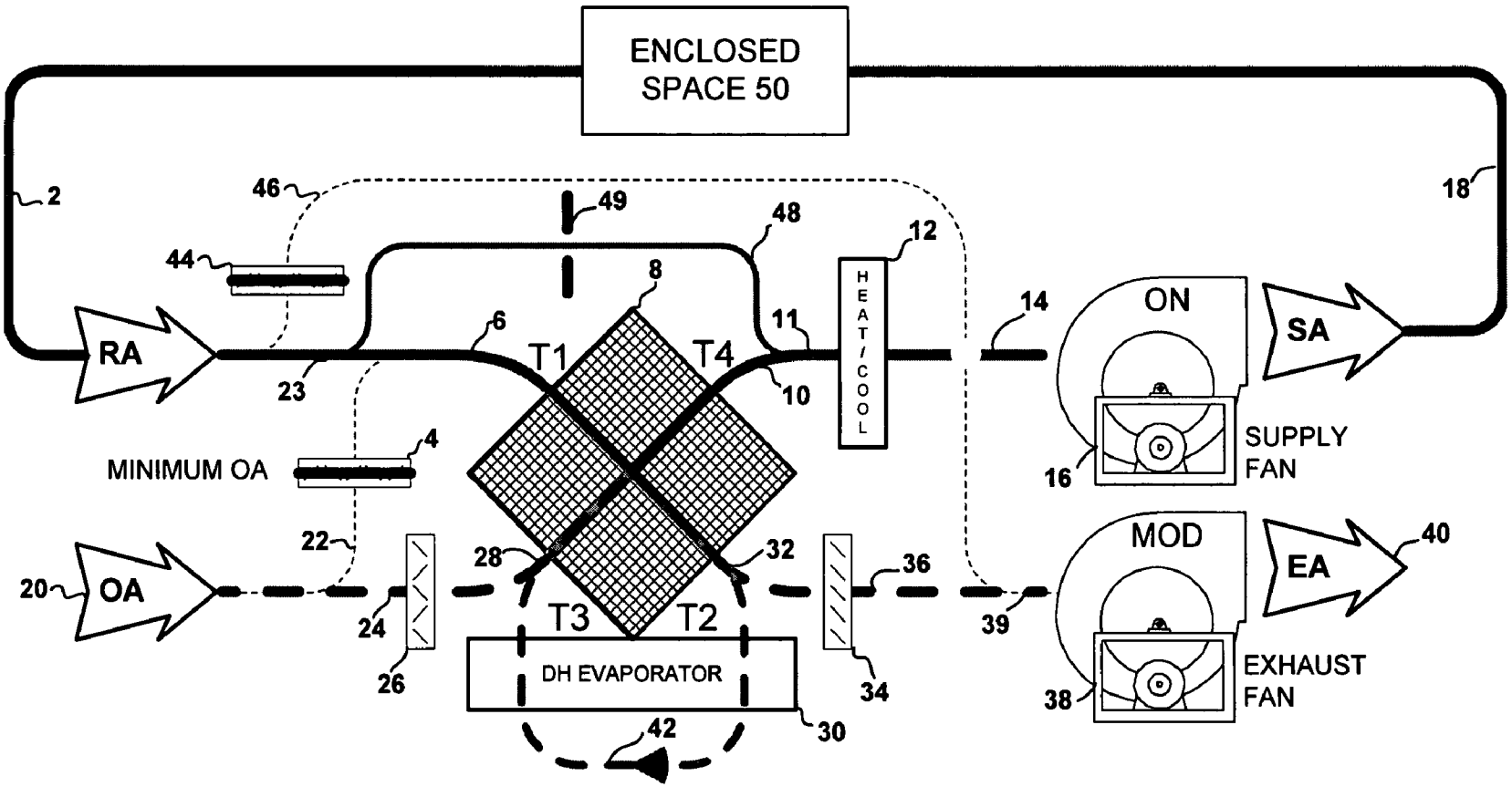
FIG. 2 illustrates a single large plate heat exchanger with airflow paths in the outside air dehumidification mode with the minimum outside air and minimum exhaust air dampers closed and the outside air damper and exhaust air fan modulating to meet the dehumidification requirements and the exhaust fan removing sufficient quantity of exhaust to maintain negative pressure in the enclosed space.

FIG. 2 illustrates the invention with a single large plate heat exchanger 8, operating in the outside air dehumidification mode where minimum outside air damper 4 and minimum exhaust air damper 44 are closed and dehumidifying coil 30 is inactive. Return airstream 2 enters heat exchanger 8 directly as airstream 6 where it gives up heat to a mixture airstream 28, of incoming outside airstream 24 and airstream 42. Air stream 6 exits heat exchanger 8 as air stream 32 which then divides into either a) airstream 36 through damper 34 as exhaust airstream 39, where it is exhausted through exhaust fan 38 as exhaust air 40, or, else, b) air stream 6 exits heat exchanger 8 as air stream 32 divides to become air stream 42 in a direction from airstream 28 to airstream 28, where it reenters heat exchanger and then emerging the heat exchanger 8 at airstream 10 where it continues on for cooling or heating as needed at heating and/or cooling coil 12, emerging as airstream 14 where it enters supply fan 16 and is discharged to the enclosed space 50 through supply airstream 18.

Figure 3:
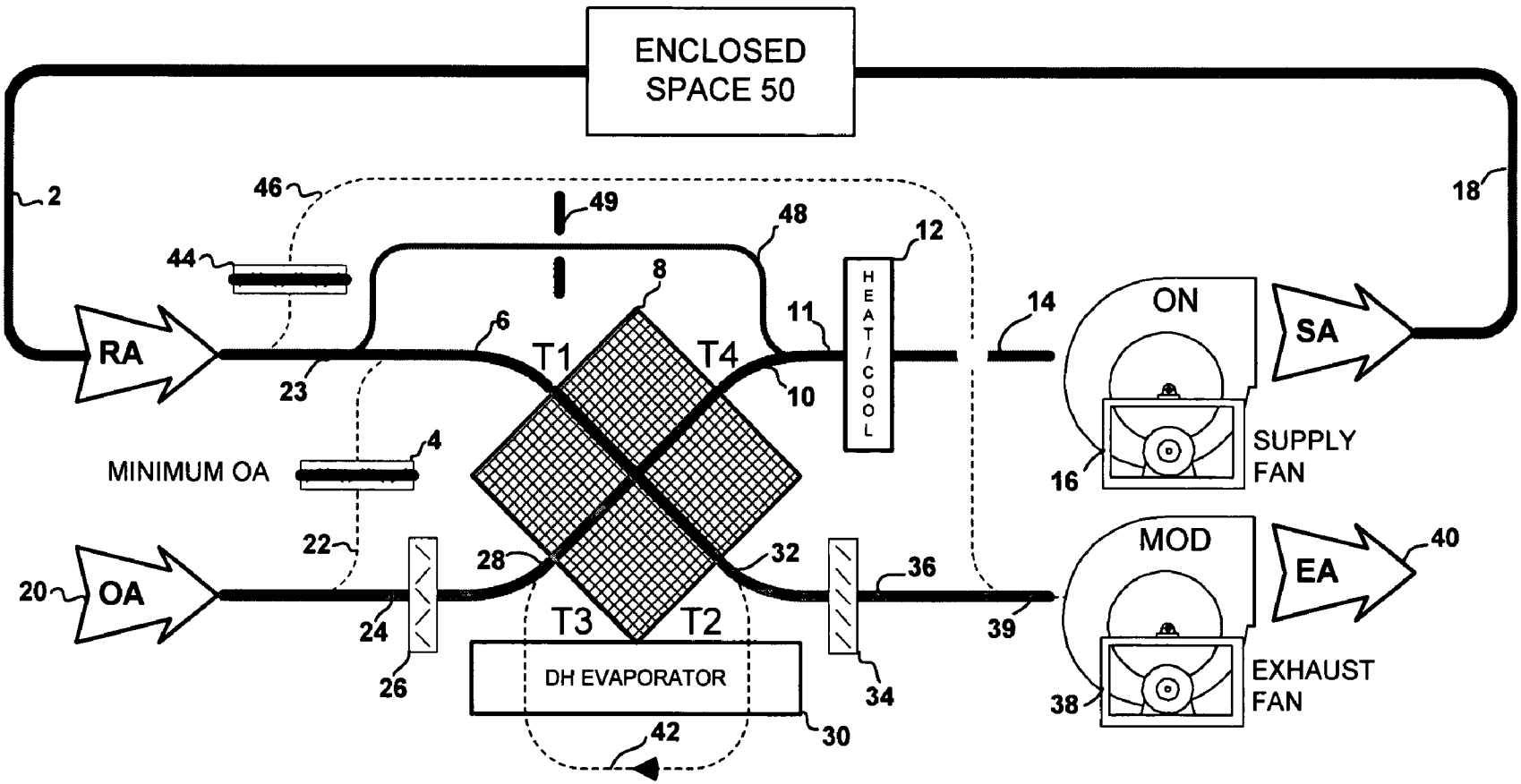
FIG. 3 illustrates a single large plate heat exchanger with airflow paths in the purge mode with the minimum outside air and minimum exhaust air dampers closed and the outside air damper wide open and the exhaust fan full volume to purge the enclosed space of contaminants while maintaining sufficient quantity of exhaust to keep negative pressure in the enclosed space.

FIG. 3 illustrates the invention with a single large plate heat exchanger 8, operating in the purge mode where minimum outside air damper 4 and minimum exhaust air damper 44 are closed and dehumidifying coil 30 is inactive. Return airstream 2 enters heat exchanger 8 directly as airstream 6 where it gives up heat to 100% outside airstream 24, emerging the heat exchanger 8 at airstream 10 where it continues on for cooling or heating as needed at heating and/or cooling coil 12, emerging as airstream 14 where it enters supply fan 16 and is discharged to the enclosed space 50 through supply airstream 18. Exhaust fan 38 operates at full volume to remove airborne contaminants.

Figure 4:
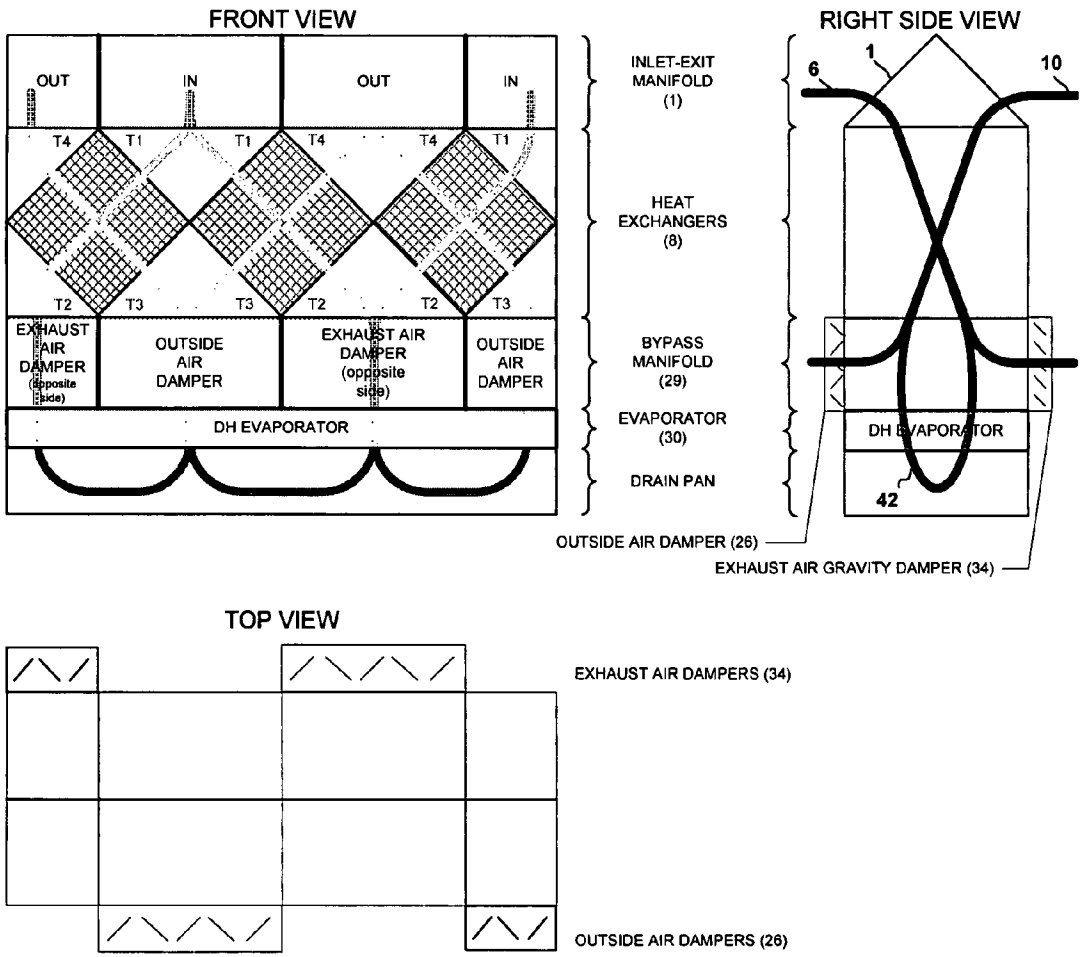
FIG. 4 illustrates 3 views of the invention in the multiple-small-plate configuration. Here, the T2/T3 manifold can be seen.

FIG. 4 illustrates the invention in a configuration with multiple small plate heat exchangers, where T1/T4 manifold 1 distributes air entering 6 and exiting 10 the heat exchangers 8 which are is arranged in parallel arrangement with regard to airflow and manifold 29 at T2/T3 is introduced to collect and distribute air to and from multiple small plate heat exchangers 8 and dehumidifying coil 30. At least one modulating outside air damper 26, At least one modulating exhaust damper 34 and manifold 29 at T2/T3 are clearly visible.

Figure 5A:
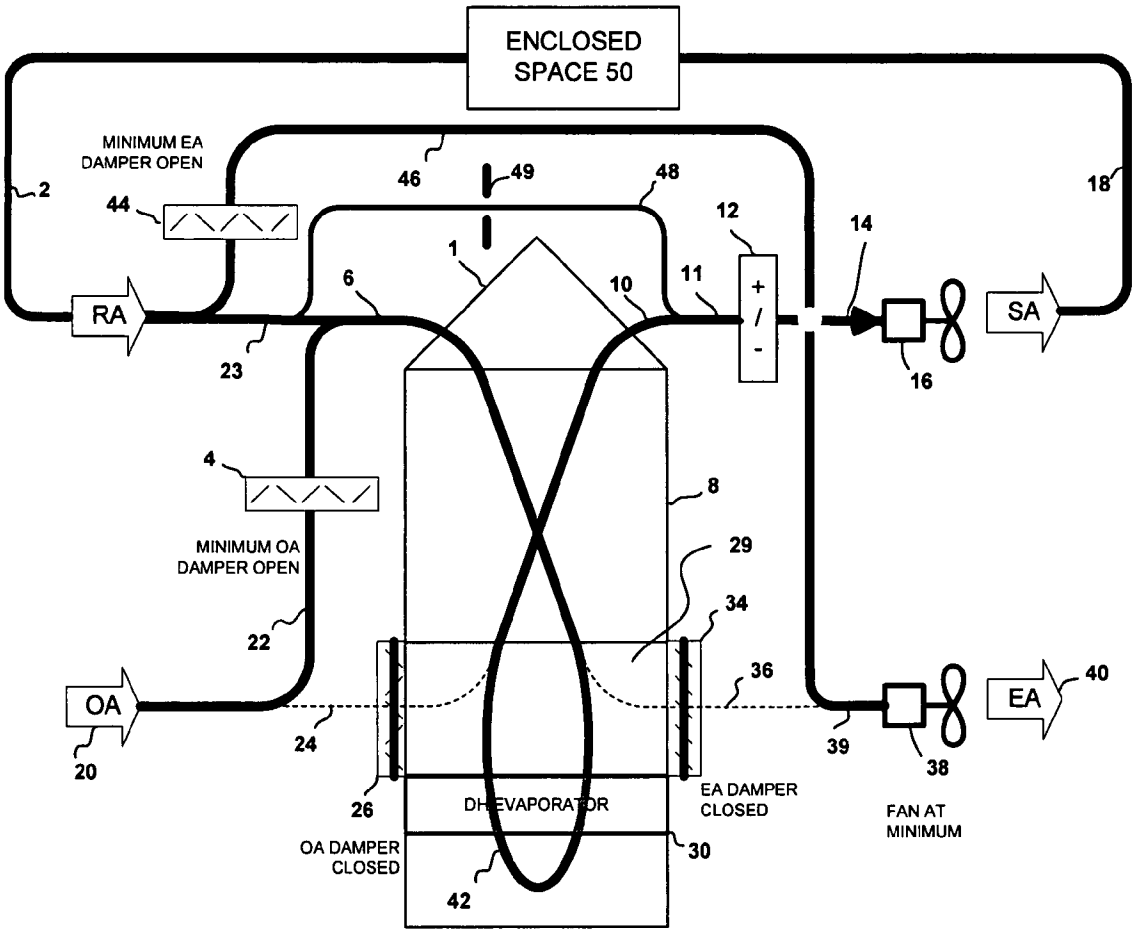
FIG. 5*a* illustrates the configuration of FIG. 1*a* using multiple-small-plate heat exchangers with airflow paths in the mechanical dehumidification/occupied mode with the minimum outside air and minimum exhaust air dampers open, the outside air and exhaust air dampers closed and the exhaust fan removing sufficient quantity of exhaust to maintain negative pressure in the enclosed space.

FIG. 5*a* illustrates the invention with multiple small plate heat exchangers 8, operating in the mechanical dehumidification/occupied mode. Return airstream 2 enters the process where it gives up a portion of its volume to minimum exhaust airstream 46 through minimum exhaust air damper 44 where it continues on to exhaust fan 38 where it discharge outdoors through airstream 40. Meanwhile, airstream 23 continues on to mix with minimum outside airstream 22 through minimum outside air damper 4. Airstream 6 enters the first pass of heat exchangers 8, where it is cooled and dehumidified emerging as airstream 42 which travels through dehumidifying coil 30 for final cooling and dehumidification prior to entering the second pass of heat exchangers 8 where it is heated and emerges as airstream 10. Airstream 10 receives further heating or cooling in heating and-or cooling coil 12, emerging as airstream 14 prior to entering supply fan 16 where it is supplied back to the enclosed space 50 through supply airstream 18.

Figure 5B:
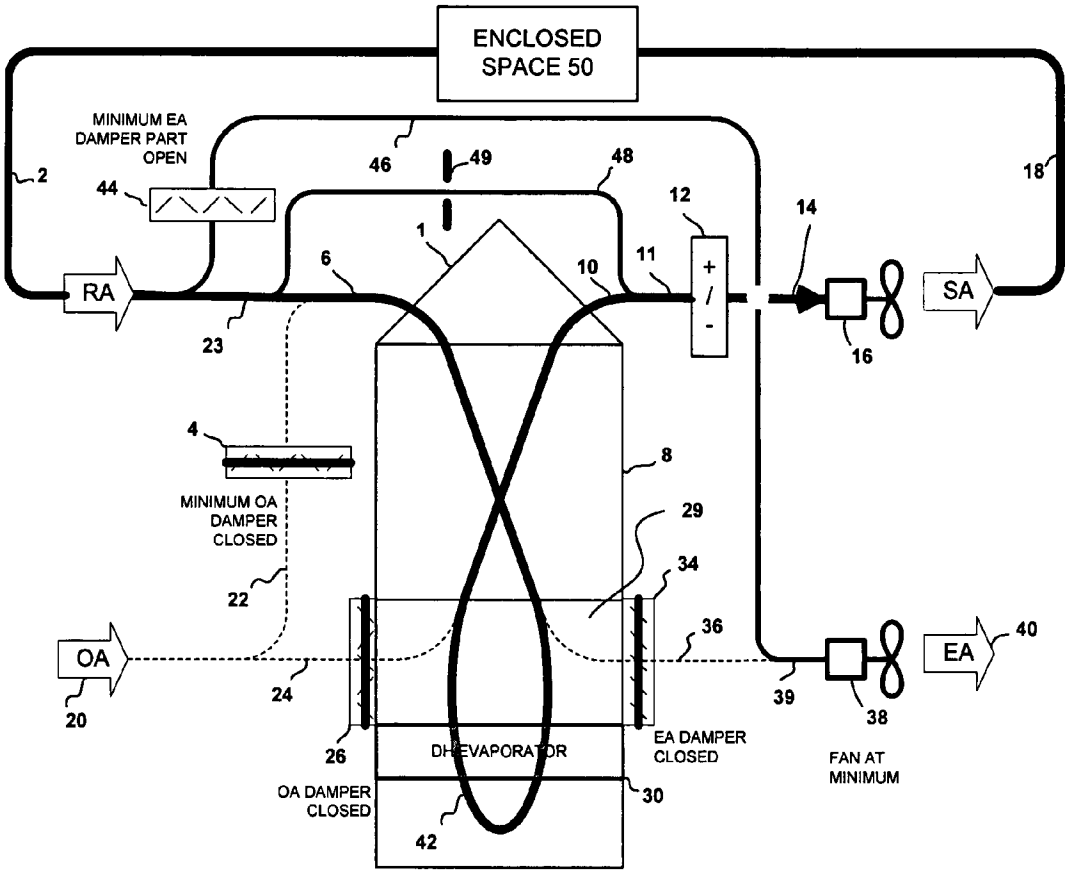
FIG. 5*b* illustrates the configuration of FIG. 1*b* using multiple-small-plate heat exchangers with the minimum outside air damper closed and minimum exhaust air damper open, and the exhaust fan removing sufficient quantity of exhaust to maintain negative pressure in the enclosed space.

FIG. 5*b* illustrates the invention with multiple small plate heat exchangers 8, operating in the mechanical dehumidification mode during unoccupied periods. Operation is the same as 1*a* above except that minimum outside air damper closes.

Figure 6:
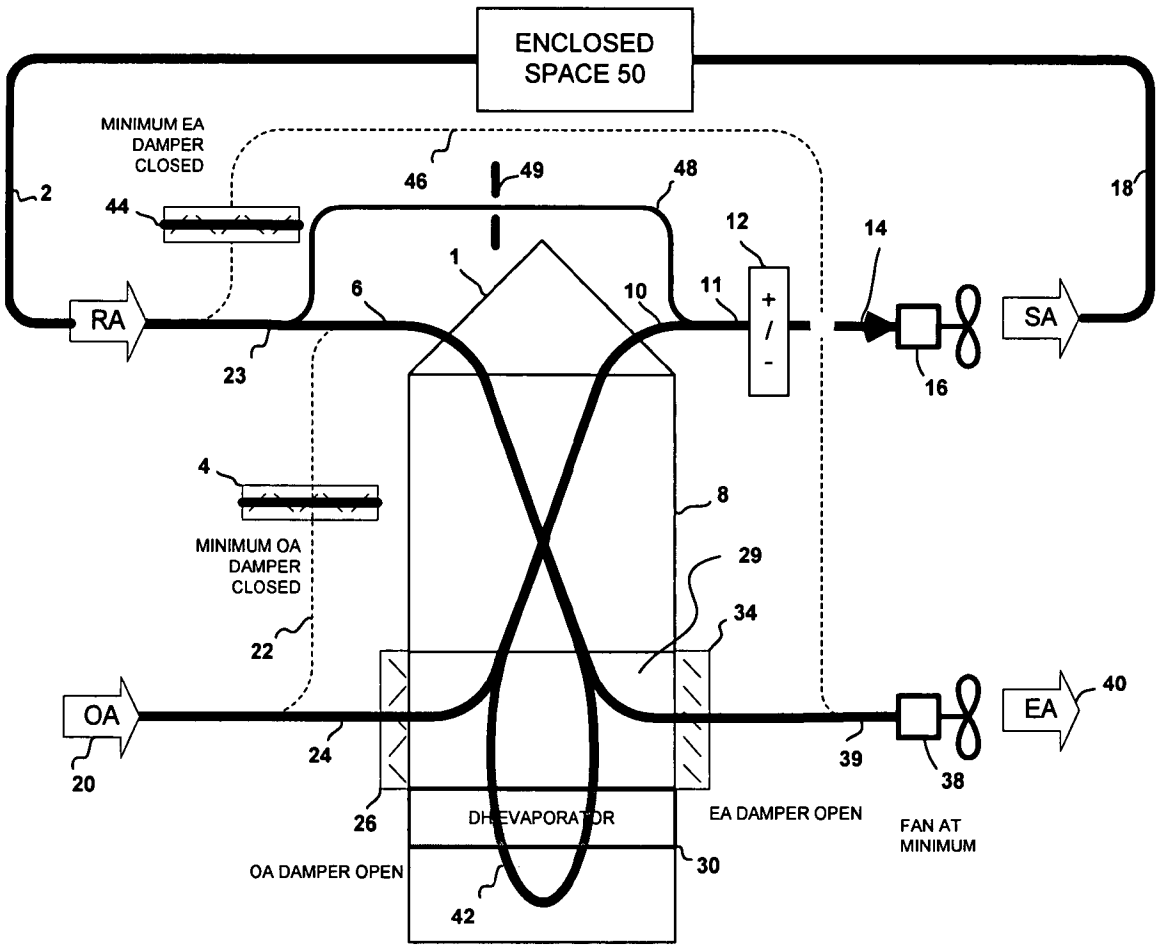
FIG. 6 illustrates the configuration of FIG. 2 using multiple-small-plate heat exchangers with airflow paths in the outside air dehumidification mode with the minimum outside air and minimum exhaust air dampers closed and the outside air damper and exhaust air fan modulating to meet the dehumidification requirements and the exhaust fan removing sufficient quantity of exhaust to maintain negative pressure in the enclosed space.

FIG. 6 illustrates the invention with multiple small plate heat exchangers 8, operating in the outside air dehumidification mode where minimum outside air damper 4 and minimum exhaust air damper 44 are closed and dehumidifying coil 30 is inactive. Return airstream 2 enters heat exchangers 8 directly as airstream 6 where it gives up heat to a mixture airstream 28, of incoming outside airstream 24 and airstream 42, emerging the heat exchangers 8 at airstream 10 where it continues on for cooling or heating as needed at heating and/or cooling coil 12, emerging as airstream 14 where it enters supply fan 16 and is discharged to the enclosed space 50 through supply airstream 18.

Figure 7:
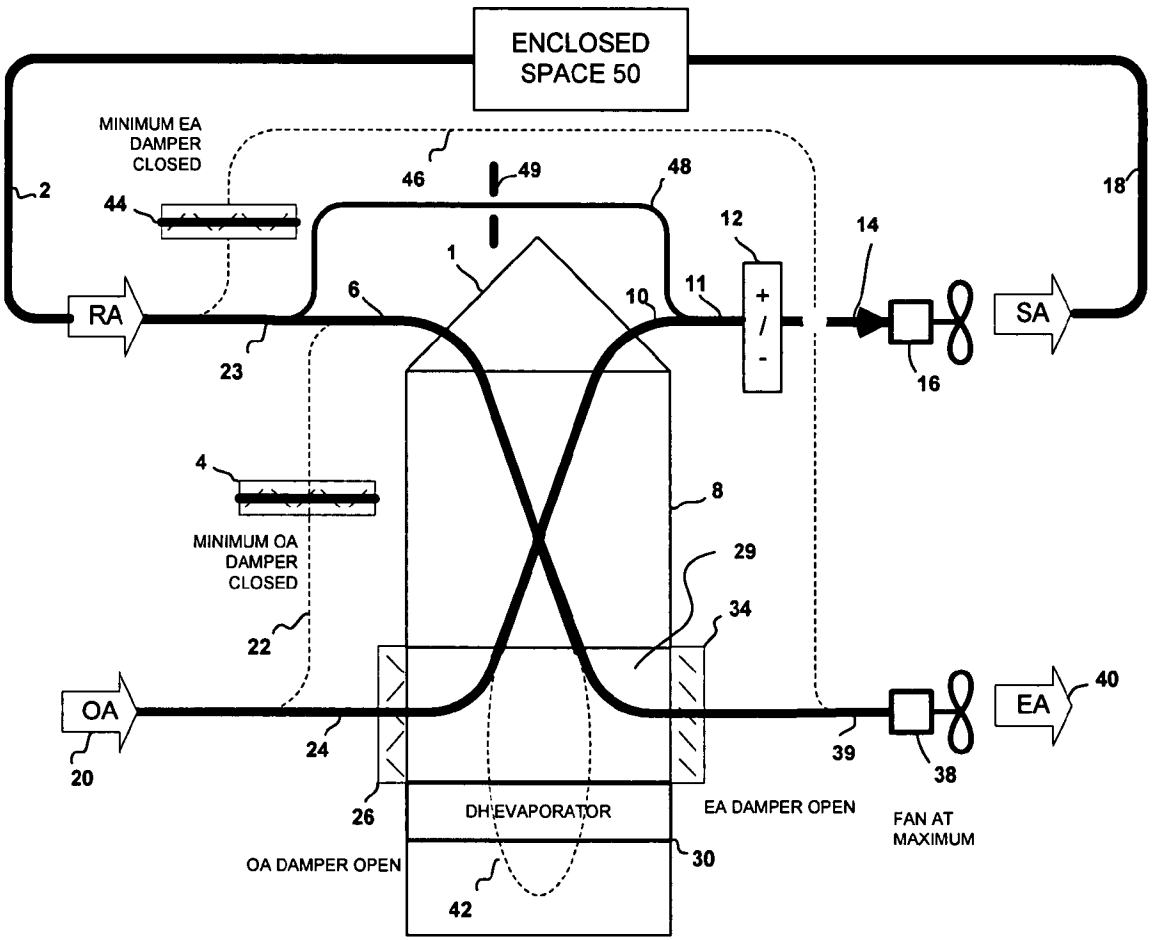
FIG. 7 illustrates the configuration of FIG. 2 using multiple-small-plate heat exchangers with airflow paths in the purge mode with the minimum outside air and minimum exhaust air dampers closed and the outside air damper wide open and the exhaust fan full volume to purge the enclosed space of contaminants while maintaining sufficient quantity of exhaust to keep negative pressure in the enclosed space.

FIG. 7 illustrates the invention with multiple small plate heat exchangers 8, operating in the purge mode where minimum outside air damper 4 and minimum exhaust air damper 44 are closed and dehumidifying coil 30 is inactive. Return airstream 2 enters heat exchangers 8 directly as airstream 6 where it gives up heat to 100% outside airstream 24, emerging the heat exchangers 8 at airstream 10 where it continues on for cooling or heating as needed at heating and/or cooling coil 12, emerging as airstream 14 where it enters supply fan 16 and is discharged to the enclosed space 50 through supply airstream 18. Exhaust fan 38 operates at full volume to remove airborne contaminants.

As also shown in FIGS. 2, 3, 6 and 7, damper 26 and/or exhaust fan 38 modulate to insure that airflow 42 travels from airstream 38 to airstream 28, and never in reverse, to avoid short circuiting of outside air 20 away from heat exchanger 8.

Figure 8:
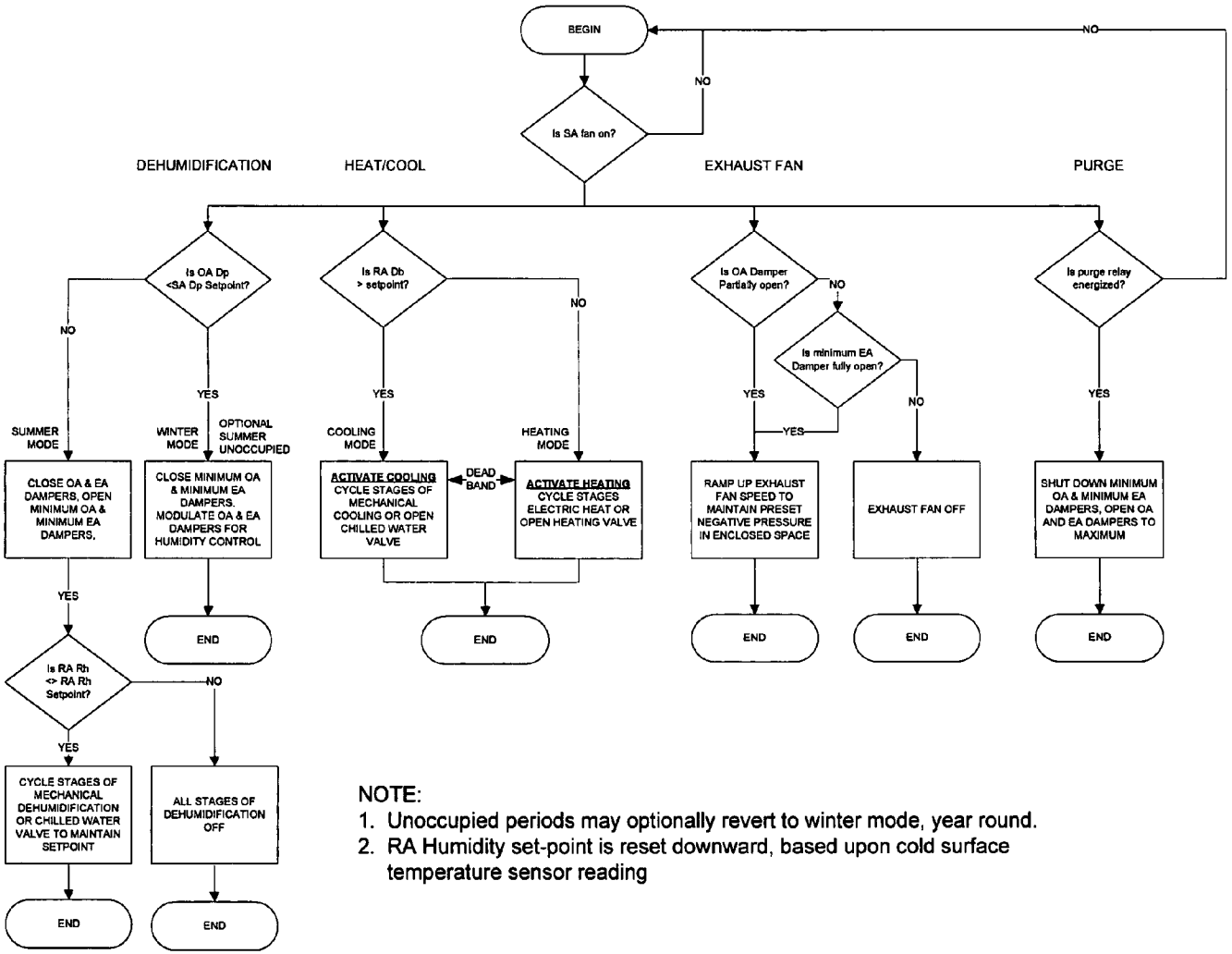
FIG. 8 is a flow chart of the hybrid dehumidification systems control sequences.

FIG. 8 is a flow chart of the hybrid dehumidification systems control sequences, where "SA" indicates "supply airstream", "OA" indicates "outside airstream", "RA" indicates "return airstream", "EA" indicates "exhaust air", "Dp" indicates "dew point" and "Rh" indicates "relative humidity". The first step in the control sequence is whether the supply airstream SA fan is "on" or not. If "on", then there are different modes of operation.

For example, as shown in FIG. 8, in the dehumidification mode, if the dewpoint Dp of the outside airsteam OA is less than the set point of the dewpoint Dp of the supply airstream SA, then the system operates in a winter mode or an optional unoccupied summer mode, where minimum outside airstream OA dampers and minimum exhaust air EA dampers are closed and modulation of outside airstream OA and exhaust airstream EA occurs for humidity control. However, in the summer mode where the dewpoint Dp of the outside airsteam OA is greater than the set point of the dewpoint Dp of the supply airstream SA, then the outside airstream OA and exhaust air stream dampers are closed and the minimum outside airstream OA and minimum exhaust airstream EA dampers are opened. Then the return airstream RA is measured as to relative humidity set point. If less than or greater than the return airstream RA predetermined set point, then cycle stages of mechanical dehumidification or chilled water valve are implemented to maintain the set point. If not, then all stages of dehumidification are "off."

FIG. 8 also shows the heat/cool mode, where the dry bulb Db of the return airstream RA is calculated as to whether it is greater than a predetermined set point. If the answer is "yes", in the cooling mode, cooling is activated by cycling stages of mechanical cooling or by opening of the chilled water valve. If the answer is "no", in the heating mode, heating is activated by cycling stages of electric heat or by opening the heating valve.

FIG. 8 further shows the exhaust fan mode, where it is first determined if the outside airstream OA damper is partially opened. If not, then the minimum exhaust air EA damper is determined to whether it is fully opened, and, if not, then the exhaust fan is turned off. If however the minimum exhaust air EA damper is fully open, or if the outside airstream OA damper is partially open, then the speed of the exhaust fan is ramped up to maintain a preset negative pressure in the enclosed space.

Moreover, in the purge mode shown in FIG. 8, it is first determined whether the purge relay is energized. If not, then it must be determined whether the supply air SA fan is on or not, and if so, whether the purge relay is then energized. If the purge relay is energized, then the minimum outside airstream OA damper and the minimum exhaust air stream EA damper are both shut down, and the open airstream OA damper and the exhaust airstream damper are opened to maximum.

In the foregoing description, certain terms and visual depictions are illustrative only: However, no unnecessary limitations are to be construed by the terms used or illustrations depicted, beyond what is shown in the prior art, since the terms and illustrations are exemplary only and are not meant to limit the scope of the present invention.

It is further noted that other modifications may be made to the present invention, without departing from the scope of the invention, as noted in the appended claims.

I claim:

1. A hybrid dehumidification system capable of operating in either mechanical or ventilation modes comprising:

at least one heat exchanger assembly for cooling and dehumidifying return air from an enclosed space in a first pass, entering at a first air flow inlet and leaving at a first air flow outlet, of said return air through said heat exchanger assembly;

a cooling coil for receiving the cooled and dehumidified air from said first pass of said heat exchanger assembly for final cooling and dehumidification, the heat exchanger assembly having a second pass entering at a second air flow inlet and leaving at a second air flow outlet to receive the finally cooled and dehumidified air from said cooling coil for cooling the return air in the first pass;

a heater/cooler for receiving and treating by heating or cooling the air leaving the second pass through said heat exchanger assembly;

at least one supply fan for delivering the treated air to said enclosed space; means for diverting a portion of said return air before entering the first pass of said at least one heat exchanger assembly;

at least one variable volume fan for exhausting said diverted portion of said return air;

a minimum outside air damper for adding outside air to said return air before said return air entering the first pass of said at least one heat exchanger assembly;

at least one modulating outside air damper, when open, for diverting a portion of said outside air into return air entering said second pass of said at least one heat exchanger assembly, and a modulating exhaust damper, when open, for diverting a portion of outside air leaving said first pass inlet of said heat exchanger assembly to said exhaust fan during a ventilation mode of operation of said system, said at least one modulating outside air damper and said modulating damper being closed during mechanical dehumidification modes of operation of said system, and, said at least one variable volume fan achieving fully modulated dehumidification of air within said enclosed space during ventilation dehumidification mode of operation.

2. The dehumidification system of claim 1 in which said enclosed space is maintained at a negative pressure through operation of said at least one variable volume exhaust fan to avoid pushing humid air into adjacent spaces or cold wall cavities where condensation could occur and cause hidden damage.

3. The dehumidification system of claim 1 in which said minimum outside air damper 4 is closed during a mechanical dehumidification unoccupied mode of said system.

4. The dehumidification system of claim 1 in which said at least one modulating outside air damper is open for diverting a portion of said outside air into return air entering said second pass of said at least one heat exchanger assembly, said system including at least one modulating exhaust air damper for exhausting a portion of return air leaving said first pass, said dehumidification system further having a minimum exhaust air damper, both said minimum exhaust air and minimum outside air dampers being closed.

5. The dehumidification system of claim 1 having a purge mode in which both said minimum exhaust air damper and minimum outside air damper are closed, said cooling coil being inactive, said return air leaving said first pass being diverted to said at least one variable volume exhaust fan, and said at least one modulating damper is open to allow all of said outside air to enter the second pass of said at least one heat exchanger, wherein the outside air leaving said heat exchanger is subject to heating or cooling in said heater/cooler and is sent to said enclosed space by said supply fan.

6. The dehumidification system of claim 1 in which said at least one heat exchanger assembly includes multiple heat exchangers in parallel.

7. A Method For a Hybrid Dehumidification System for enclosed indoor space applications with high internally-generated moisture loads comprising the steps of:

a) Mechanically lowering the dew-point of air;

b) Using a mechanical cooling based system, to achieve a predetermined temperature and humidity level that removes a desired amount of moisture or by using outdoor air that is at the predetermined temperature and humidity level or lower;

c) Providing at least one heat exchanger;

d) Using a control system to decide whether cooling or ventilation is best to control humidity under a given set of conditions;

e) Furnishing required outside air and exhaust air for ventilation by using a minimum outside air and minimum exhaust air damper that introduces sufficient outside air to ventilate an enclosed space and to exhaust air sufficient to maintain negative pressure within said enclosed space as may be required to avoid pushing humid air into adjacent spaces or into cold wall cavities;

f) Providing an air bypass with a regulating orifice to provide additional airflow to meet total airflow requirements of the system.

8. A Method For a Hybrid Dehumidification System, as in claim 7, for an enclosed airspace having a swimming pool further comprising:

a) Placing the dehumidification system in an outside air ventilation mode during non-use;

b) Shutting down said minimum outside air damper when operating the mechanical dehumidification mode.

9. A Method For a Hybrid Dehumidification System as in claim 7, wherein said at least one heat exchanger provides airflow path in a mechanical dehumidification/occupied mode with the minimum outside air and minimum exhaust air dampers open wherein further the outside air and exhaust air dampers are closed and the exhaust fan removes a predetermined quantity of exhaust to maintain negative pressure in the enclosed space.

10. A Method For a hybrid dehumidification system as in claim 7, wherein said at least one heat exchanger provides an airflow path in a mechanical dehumidification mode during unoccupied periods, wherein further the minimum outside air damper is closed and the minimum exhaust air damper is open, and the exhaust fan removes a predetermined quantity of exhaust to maintain negative pressure in the enclosed space.

11. A Method For a hybrid dehumidification system as in claim 7 wherein said at least one heat exchanger provides airflow paths in the outside air dehumidification mode wherein with the minimum outside air and minimum exhaust air dampers are closed and wherein the outside air damper and the exhaust air fan modulate together to provide predetermined dehumidification and the exhaust fan removes a predetermined quantity of exhaust to maintain negative pressure in the enclosed space to insure that outside air flow only through said heat exchanger and not backwards direction to said exhaust fan.

12. A Method For a hybrid dehumidification system as in claim 7 wherein said at least one heat exchanger provides airflow paths in a purge mode with the minimum outside air and minimum exhaust air dampers closed, wherein the outside air damper is kept wide open and the exhaust fan is kept at full volume, thereby purging the enclosed space of contaminants, while maintaining predetermined quantity of exhaust to maintain negative pressure in the enclosed space to insure that outside air flow only through said heat exchanger and not backwards direction to said exhaust fan.

13. A Method For a hybrid dehumidification system as in claim 7 wherein said at least one heat exchanger is a plurality of small-plate hand exchangers, each airflow paths in the mechanical dehumidification/occupied mode with the minimum outside air and minimum exhaust air dampers kept open, wherein respective outside air and exhaust air dampers of said respective heat exchangers are closed and the exhaust fan removes a predetermined quantity of exhaust to maintain negative pressure in the enclosed space.

14. A Method For a hybrid dehumidification system as in claim 7 wherein said at least one heat exchanger is a plurality of small-plate heat exchangers, each having respective air paths with the respective minimum outside air damper closed and minimum exhaust air damper open, wherein the exhaust fan removes a predetermined quantity of exhaust to maintain negative pressure in the enclosed space.

15. A Method For a hybrid dehumidification system as in claim 7 wherein said at least one heat exchanger is a plurality of multiple-small plate heat exchangers, each having respective airflow paths in the outside air dehumidification mode with the respective minimum outside air and minimum exhaust air dampers closed, wherein the outside air damper and exhaust air fan modulate to provide predetermined dehumidification, and the exhaust fan removes a predetermined quantity of exhaust to maintain negative pressure in the enclosed space to insure that outside air flow only through said heat exchanger and not backwards direction to said exhaust fan.

16. A Method For a Hybrid dehumidification system as in claim 7 wherein said at least one heat exchanger is a plurality of multiple small plate heat exchangers, each having respective airflow paths in the purge mode with the minimum outside air and minimum exhaust air dampers closed, wherein the outside air damper is kept wide open and the exhaust fan provides full volume to purge the enclosed space of contaminants while maintaining a predetermined quantity of exhaust to keep negative pressure in the enclosed space to insure that outside air flow only through said heat exchanger and not backwards direction to said exhaust fan.

17. A Method For a Hybrid Dehumidification System, as in claim 7, further comprising the step of:

Providing an exhaust purge device to purge said enclosed space of contaminants.

* * * * *